US006390183B2

(12) United States Patent
Aoyagi et al.

(10) Patent No.: US 6,390,183 B2
(45) Date of Patent: May 21, 2002

(54) HEAT EXCHANGER

(75) Inventors: Osamu Aoyagi; Toshiaki Ando; Shoichi Yokoyama, all of Shiga (JP)

(73) Assignee: Matsushita Electric Industrial Co. Ltd., Osaka (JP)

( * ) Notice: Subject to any disclaimer, the term of this patent is extended or adjusted under 35 U.S.C. 154(b) by 0 days.

(21) Appl. No.: 09/313,785

(22) Filed: May 17, 1999

(30) Foreign Application Priority Data

May 18, 1998 (JP) ..... 10-134869
Apr. 21, 1999 (JP) ..... 11-113577

(51) Int. Cl.[7] ..... F28F 13/12; F28F 13/08
(52) U.S. Cl. ..... 165/146; 165/147; 165/109.1
(58) Field of Search ..... 165/109.1, 146, 165/147

(56) References Cited

U.S. PATENT DOCUMENTS 2,709,128 A * 5/1955 Krause ..... 165/109.1
2,895,508 A * 7/1959 Drake ..... 165/109.1
3,232,341 A * 2/1966 Woodworth ..... 165/146
3,339,631 A * 9/1967 Mcgurty et al. ..... 165/109.1
3,921,711 A * 11/1975 Westbrock ..... 165/109.1
5,265,443 A * 11/1993 Yuzawa et al. ..... 62/498
5,409,675 A * 4/1995 Narayanan ..... 165/146
6,092,589 A * 7/2000 Filus et al. ..... 165/109.1

* cited by examiner

*Primary Examiner*—Henry Bennett
*Assistant Examiner*—Tho V Duong
(74) *Attorney, Agent, or Firm*—Armstrong, Westerman & Hattori, LLP

(57) ABSTRACT

In a heat exchanger of the present invention for exchanging heat between fluid flowing in a flow passage in a heat exchanger tube and fluid flowing outside of said heat exchanger tube, a solid bar-like insertion member or a hollow bar-like insertion member whose opposite ends are closed is provided in said flow passage in which a fluid having phase change flows in gas-liquid two phase state or liquid phase state, a cross section of said insertion member is formed into a substantially circle shape, a polygonal shape or a starlike shape, and a cross-sectional area of a flow passage in which said fluid flows is reduced as a mass flow rate quality of said fluid is reduced. With this construction, it is possible to restrain the pressure loss at the time of evaporation, and the evaporation ability can be enhanced or can be restrained from being deteriorated.

16 Claims, 14 Drawing Sheets

PRIOR ART

PRIOR ART

PRIOR ART

PRIOR ART

PRIOR ART

PRIOR ART

HEAT EXCHANGER

TECHNICAL FIELD

The present invention relates to a heat exchanger such as a heat exchanger having fins or a double tube heat exchanger mainly used in an air conditioner.

BACKGROUND TECHNIQUE

As shown in FIG. 8, a conventional heat exchanger having fins comprises fins 201 arranged at a predetermined distance from one another, and heat exchanger tubes 202 inserted through fin surfaces of the fins 201 perpendicularly to the latter. A current 203 of air flows in the direction of the arrow between the fins, and exchanges heat with fluid flowing the passages of the heat exchanger tubes 202. When such a heat exchanger having fins is used, it is common that an end portion thereof is bent at a predetermined radius of curvature R, and the heat exchanger is accommodated in an outdoor unit of an air conditioner.

First prior art (Japanese Patent Application Laid-open No.S61-15089) is shown in FIGS. 9*a* and 9*b*.

FIG. 9*a* is a vertical sectional view showing a portion of a heat exchanger tube, and FIG. 9*b* is an enlarged sectional view of an essential portion showing an inner wall surface of the heat exchanger tube.

According to the first prior art of the heat exchanger, a coil 204 comprising spirally wound metal fine wire is inserted into a heat exchanger tube 202, an outer periphery of this coil 204 is tightly fixed to an inner surface of the heat exchanger tube 202, and a large number of powdery members 205 are jointed to the inner surface of the heat exchanger tube 202 to form a porous material layer.

According to this structure, heat transfer area of the inner surface of the heat exchanger tube 202 is increased, a turbulent flow effect, a capillary action effect and a nucleate boiling effect are exhibited to enhance the heat transfer performance.

Second prior art (Japanese Utility Model Registration Application Laid-open No.S58-52491) is shown in FIG. 10.

FIG. 10 is a sectional view of a heat exchanger having fins taken along the surface passing through the center of a heat exchanger tube thereof.

According to the second prior art, a spacer 206 which can be deformed by heat is inserted into a heat exchanger tube 202, and after the insertion, the spacer 206 is heated so that the spacer 206 is tightly adhered to an inner wall of the tube. A fin group 201 is jointed to an outer peripheral surface of the heat exchanger tube 202.

With this structure, the heat transfer area of the inner surface of the heat exchanger tube 202 is increased, and a turbulent flow effect is exhibited to enhance the heat transfer performance.

Third prior art (Japanese Patent Application No.H10-2638) is shown in FIG. 11.

FIG. 11 is a perspective view showing a structure of a heat exchanger having fins.

According to the third prior art, in the heat exchanger having fins functioning as a condenser, the number of paths of an outlet tube 207 for refrigerant is reduced, the outlet tube 207 is disposed in the windward side with respect to the direction 203 of air flow, and a fin 201 between the adjacent tubes 202 at the downwind side is provided with a slit 208 in the longitudinal direction of the fin 201.

With this structure, it is regarded that when the heat exchanger is used as a condenser, since it is possible to increase the speed in the tube mainly by the outlet tube 207 which is excessively cooled region, the heat transfer performance is enhanced, and by disposing the excessively cooled region having low temperature in the windward side, it is possible to increase the temperature difference between the air and the excessively cooled region, and the condense performance can be enhanced.

Forth prior art (Japanese Patent Application No.S57-127732) is shown in FIG. 12.

FIG. 12 is a perspective view showing a structure of a heat exchanger having fins.

According to the fourth prior art, in the heat exchanger having fins functioning as a condenser, the diameter of an outlet tube 209 of refrigerant is made thinner than those of other portions.

According to this structure, it is regarded that when the heat exchanger is used as a condenser, since it is possible to increase the speed in the tube by the outlet tube 209 which is excessively cooled region, the heat transfer performance is enhanced, and by disposing the excessively cooled region having low temperature in the windward side, it is possible to increase the temperature difference between the air and the excessively cooled region, and the condense performance can be enhanced.

Fifth prior art (Japanese Patent Application No.H2-103355) is shown in FIGS. 13*a* and 13*b*.

FIG. 13*a* is a perspective view showing a structure of a heat exchanger having fins, and FIG. 13*b* is a sectional view of a heat exchanger tube constituting the heat exchanger.

According to the fifth prior art, in the heat exchanger having fins functioning as a condenser, inner rods 211 are inserted in the heat exchanger tube 210 in the vicinity of the refrigerant outlet.

With this structure, it is regarded that the heat exchanger having fins used as the condenser can reduce the amount of refrigerant charged by the inner rods 211 inserted in the excessive cooled regions.

However, according to the structure of the first prior art, since a wire of very small diameter is used as the coil, the volume of the tube can not be remarkably reduced by inserting the coil. Further, when the heat exchanger is used as a condenser, the inner surface of the tube which is the heat transfer surface is liable to be covered with a thick condensed liquid film and there is a problem that the heat exchanging performance is lowered.

According to the structure of the second prior art, since this prior art mainly aims at increasing the heat transfer area of the inner surface of the heat transfer tube and at the turbulent flow effect, and the thickness of the spacer is not specified, it is judged that the thickness of the spacer is equal to that of the heat exchanger tube, and the volume of the tube can not be remarkably reduced by inserting the coil. Further, when the heat exchanger is used as a condenser, the inner surface of the tube which is the heat transfer surface is liable to be covered with a thick condensed liquid film and there is a problem that the heat exchanging performance is lowered.

According to the structure of the third prior art, the current speed can be increased by minimizing the number of paths, but the current speed of the minimum paths is the highest, and it is not possible to further enhance the speed. Further, the speed can only be changed at least for one heat exchanger tube by on heat exchanger tube. It is not possible to reduce the volume in the tube. Further, when the heat exchanger is used as a condenser, the inner surface of the tube which is the heat transfer surface is liable to be covered with a thick condensed liquid film and there is a problem that the heat exchanging performance is lowered.

According to the structure of the fourth prior art, the current speed in the thin tube can be increased, and the current speed can be arbitrarily determined by selecting the diameter of the thin tube, but in order to change the diameter of the thin tube, it is necessary to change the molding dies of the fin having a hole in which the thin tube is inserted. Therefore, it is necessary to make a significant investment in the molding dies, and it is not easy to change the diameter. It is not possible to reduce the volume in the tube. Further, when the heat exchanger is used as a condenser, the inner surface of the tube which is the heat transfer surface is liable to be covered with a thick condensed liquid film and there is a problem that the heat exchanging performance is lowered.

According to the structure of the fifth prior art, this is only effective to reduce the amount of refrigerant when the heat exchanger is used as a condenser. When the heat exchanger is used as an evaporator, since it is described that a member which satisfies the pressure of 4 $kg/cm^2$ is inserted to the outlet of the condenser, this will bring about a remarkable increase in pressure loss, and there is a problem that the evaporation ability is remarkably lowered.

The present invention has been accomplished to solve the problems of the prior art, and it is an object of the invention to enhance the evaporation ability or to restrain the evaporation ability from lowering while restraining the pressure loss at the time of evaporation by inserting, into a heat exchanger tube, a member which reduces the refrigerant flow passage as the mass flow rate quality (dryness fraction) is increased.

Further, when the heat exchanger is used as a condenser, it is another object of the invention to provide a heat exchanger capable of reducing the thickness of the liquid film of an inner surface of a tube by adhering the condensed liquid to an outer surface of a member inserted into two-phase region, reducing the cross-sectional area of the flow passage in the heat exchanger tube by the insertion member, enhancing the current flow of the refrigerant flowing in the heat exchanger tube, and enhancing the heat exchanging performance.

Furthermore, it is another object of the invention to provide a heat exchanger capable of reducing the amount of refrigerant to be charged by reducing the volume in the heat exchanger tube.

DISCLOSURE OF THE INVENTION

According to a first aspect, there is provided a heat exchanger for exchanging heat between fluid flowing in a flow passage in a heat exchanger tube and fluid flowing outside of the heat exchanger tube, wherein a solid bar-like insertion member or a hollow bar-like insertion member whose opposite ends are closed is provided in the flow passage in which a fluid having phase change flows in gas-liquid two phase state or liquid phase state, a cross section of the insertion member is formed into a substantially circle shape, a polygonal shape or a starlike shape, and a cross-sectional area of a flow passage in which the fluid flows is reduced as a mass flow rate quality of the fluid is reduced.

According to this construction, since the influence of the pressure loss is increased as the mass flow rate quality is increased, the pressure loss can effectively be reduced by widening the flow passage having great mass flow rate quality, and the evaporation ability can be enhanced or restrained from lowering. When the heat exchanger is used as a condenser, if the current speed of the refrigerant flowing in the heat exchanger tube in a flow passage having small mass flow rate quality is increased, it is possible to reduce the thickness of the liquid film of the inner surface of the tube due to the condensed liquid, and it is possible to obtain a heat exchanger having high heat exchanging performance in the tube. Further, since the area of the outer surface of the insertion member is increased by forming the cross section of the insertion member into polygonal shape or starlike shape, the amount of condensed liquid adhered to the insertion member is increased, and it is possible to further reduce the thickness of the condensed liquid film on the inner peripheral surface of the heat exchanger tube, and to enhance the heat transfer coefficient. Further, since the volume in the heat exchanger tube can be reduced, the amount of refrigerant to be charged can be reduced.

According to a second aspect, there is provided a heat exchanger for exchanging heat between fluid flowing in a flow passage in a heat exchanger tube and fluid flowing outside of the heat exchanger tube, wherein a bar-like insertion member is provided in the flow passage in which a fluid having phase change flows in gas-liquid two phase state or liquid phase state, and a cross-sectional area of a flow passage in which the fluid flows is reduced as a mass flow rate quality of the fluid is reduced.

According to this construction, since the influence of the pressure loss is increased as the mass flow rate quality is increased, the pressure loss can effectively be reduced by widening the flow passage having great mass flow rate quality, and the evaporation ability can be enhanced or restrained from lowering. When the heat exchanger is used as a condenser, if the current speed of the refrigerant flowing in the heat exchanger tube in a flow passage having small mass flow rate quality is increased, it is possible to reduce the thickness of the liquid film of the inner surface of the tube due to the condensed liquid, and it is possible to obtain a heat exchanger having high heat exchanging performance in the tube. Further, since the volume in the heat exchanger tube can be reduced, the amount of refrigerant to be charged can be reduced.

According to a third aspect, in the first or second aspect, a cross-sectional area of the insertion member is discontinuously varied.

According to this construction, it is possible to reduce the cross-sectional area of the flow passage in which the fluid flows can be reduced as the mass flow rate quality of the fluid is reduced by varying the cross-sectional area of the insertion member. Further, it is possible to easily change the cross-sectional area of the flow passage by combining insertion members having different diameters.

According to a fourth aspect, in the first or second aspect, a cross-sectional area of the insertion member is continuously varied.

According to this construction, it is possible to reduce the cross-sectional area of the flow passage in which the fluid flows can be reduced as the mass flow rate quality of the fluid is reduced by varying the cross-sectional area of the insertion member. Further, it is possible to optimally reduce the pressure loss and to exploit the full heat exchanging performance by continuously changing the cross-sectional area of the insertion member.

According to a fifth aspect, there is provided a heat exchanger for exchanging heat between fluid flowing in a flow passage in a heat exchanger tube and fluid flowing outside of the heat exchanger tube, wherein a solid bar-like insertion member or a hollow bar-like insertion member whose opposite ends are closed is provided in the flow passage in which a fluid having phase change flows in gas-liquid two phase state or liquid phase state, and a cross section of the insertion member is formed into a substantially circle shape, a polygonal shape or a starlike shape.

According to this construction, when the heat exchanger is used as a condenser, the thickness of the liquid film of the inner surface of the tube by the condensed liquid in the two-phase region or liquid phase can be reduced, and the current speed of the refrigerant flowing in the heat exchanger tube can be enhanced so that a heat exchanger having high heat exchanging performance in the tube can be obtained. Further, since the area of the outer surface of the insertion member is increased by forming the cross section of the insertion member into polygonal shape or starlike shape, the amount of condensed liquid adhered to the insertion member is increased, and it is possible to further reduce the thickness of the condensed liquid film on the inner peripheral surface of the heat exchanger tube, and to enhance the heat transfer coefficient. Further, since the volume in the heat exchanger tube can be reduced, the amount of refrigerant to be charged can be reduced.

According to a sixth aspect, in any one of the first, second and fifth aspects, the insertion member is provided on its outer surface with a groove, or a bump and a dip.

According to this construction, since the area of the outer surface of the insertion member is increased, the amount of condensed liquid adhered to the insertion member is increased, and it is possible to further reduce the thickness of the condensed liquid film on the inner peripheral surface of the heat exchanger tube, and to enhance the heat transfer coefficient.

According to a seventh aspect, in any one of the first, second and fifth aspects, the insertion member is made of porous material.

According to this construction, since the area of the outer surface of the insertion member is increased by the porous material, the amount of condensed liquid adhered to the insertion member is increased, and it is possible to further reduce the thickness of the condensed liquid film on the inner peripheral surface of the heat exchanger tube, and to enhance the heat transfer coefficient.

According to an eighth aspect, in any one of the first, second and fifth aspects, the insertion member is provided in plural into bundle.

According to this construction, since the plurality of insertion members are provided, the area of the outer surfaces of the insertion members is increased, the amount of condensed liquid adhered to the insertion member is increased, and it is possible to further reduce the thickness of the condensed liquid film on the inner peripheral surface of the heat exchanger tube, and to enhance the heat transfer coefficient.

According to a ninth aspect, in any one of the first, second and fifth aspects, a refrigerant comprising hydro fluorocarbon (HFC) or hydrocarbon (HC) as main component is used as the fluid flowing in the flow passage in the heat exchanger tube.

According to this construction, the refrigerant comprising hydro fluorocarbon (HFC) or hydrocarbon (HC) as main component has higher refrigerant density at the same cycle point than conventional R22 and thus has lower current speed, and the pressure loss is lowered to about 70% when the refrigerant has the same ability as the conventional R22. For this reason, the heat transfer coefficient is enhanced and the heat exchanging coefficient is also enhanced especially by using R410A, propane (R290) or the like as refrigerant. Further, if the hydro fluorocarbon (HFC) or hydrocarbon (HC) is used, the value of the ozone destroy potential (ODP) is 0. Although the value of the global warming potential (GWP) of the hydro fluorocarbon (HFC) is high, the global warming potential (GWP) of the hydrocarbon (HC) is extremely closer to 0. Therefore, the environmental problem can be overcome.

According to a tenth aspect, in the third aspect, the insertion member is provided on its outer surface with a groove, or a bump and a dip.

According to this construction, since the area of the outer surface of the insertion member is increased, the amount of condensed liquid adhered to the insertion member is increased, and it is possible to further reduce the thickness of the condensed liquid film on the inner peripheral surface of the heat exchanger tube, and to enhance the heat transfer coefficient.

According to an eleventh aspect, in the third aspect, the insertion member is made of porous material.

According to this construction, since the area of the outer surface of the insertion member is increased by the porous material, the amount of condensed liquid adhered to the insertion member is increased, and it is possible to further reduce the thickness of the condensed liquid film on the inner peripheral surface of the heat exchanger tube, and to enhance the heat transfer coefficient.

According to a twelfth aspect, in the third aspect, the insertion member is provided in plural into bundle.

According to this construction, since the plurality of insertion members are provided, the area of the outer surfaces of the insertion members is increased, the amount of condensed liquid adhered to the insertion member is increased, and it is possible to further reduce the thickness of the condensed liquid film on the inner peripheral surface of the heat exchanger tube, and to enhance the heat transfer coefficient.

According to a thirteenth aspect, in the third aspect, a refrigerant comprising hydro fluorocarbon (HFC) or hydrocarbon (HC) as main component is used as the fluid flowing in the flow passage in the heat exchanger tube.

According to this construction, the refrigerant comprising hydro fluorocarbon (HFC) or hydrocarbon (HC) as main component has higher refrigerant density at the same cycle point than conventional R22 and thus has lower current speed, and the pressure loss is lowered to about 70% when the refrigerant has the same ability as the conventional R22. For this reason, the heat transfer coefficient is enhanced and the heat exchanging coefficient is also enhanced especially by using R410A, propane (R290) or the like as refrigerant. Further, if the hydro fluorocarbon (HFC) or hydrocarbon (HC) is used, the value of the ozone destroy potential (ODP) is 0. Although the value of the global warming potential (GWP) of the hydro fluorocarbon (HFC) is high, the global warming potential (GWP) of the hydrocarbon (HC) is extremely closer to 0. Therefore, the environmental problem can be overcome.

According to a fourteenth aspect, in the fourth aspect, the insertion member is provided on its outer surface with a groove, or a bump and a dip.

According to this construction, since the area of the outer surface of the insertion member is increased, the amount of condensed liquid adhered to the insertion member is increased, and it is possible to further reduce the thickness of the condensed liquid film on the inner peripheral surface of the heat exchanger tube, and to enhance the heat transfer coefficient.

According to a fifteenth aspect, in the fourth aspect, the insertion member is made of porous material.

According to this construction, since the area of the outer surface of the insertion member is increased by the porous material, the amount of condensed liquid adhered to the insertion member is increased, and it is possible to further reduce the thickness of the condensed liquid film on the inner peripheral surface of the heat exchanger tube, and to enhance the heat transfer coefficient.

According to a sixteenth aspect, in the fourth aspect, the insertion member is provided in plural into bundle.

According to this construction, since the plurality of insertion members are provided, the area of the outer surfaces of the insertion members is increased, the amount of condensed liquid adhered to the insertion member is increased, and it is possible to further reduce the thickness of the condensed liquid film on the inner peripheral surface of the heat exchanger tube, and to enhance the heat transfer coefficient.

According to a seventeenth aspect, in the fourth aspect, a refrigerant comprising hydro fluorocarbon (HFC) or hydrocarbon (HC) as main component is used as the fluid flowing in the flow passage in the heat exchanger tube.

According to this construction, the refrigerant comprising hydro fluorocarbon (HFC) or hydrocarbon (HC) as main component has higher refrigerant density at the same cycle point than conventional R22 and thus has lower current speed, and the pressure loss is lowered to about 70% when the refrigerant has the same ability as the conventional R22. For this reason, the heat transfer coefficient is enhanced and the heat exchanging coefficient is also enhanced especially by using R410A, propane (R290) or the like as refrigerant. Further, if the hydro fluorocarbon (HFC) or hydrocarbon (HC) is used, the value of the ozone destroy potential (ODP) is 0. Although the value of the global warming potential (GWP) of the hydro fluorocarbon (HFC) is high, the global warming potential (GWP) of the hydrocarbon (HC) is extremely closer to 0. Therefore, the environmental problem can be overcome.

BEST MODE FOR CARRYING OUT THE INVENTION

Embodiments of the present invention will be explained with reference to the drawings. Although heat exchangers having fins will be explained in the following description of the embodiments, effect of the present invention is obtained in a flow passage in which refrigerant having phase change characteristics flows, and the same effect can be obtained even in inside or outside of inner tube of a heat exchanger comprising only a heat exchanger tube such as double tube heat exchanger if the fluid has phase change characteristic flows.

(First Embodiment)

Figure 1:
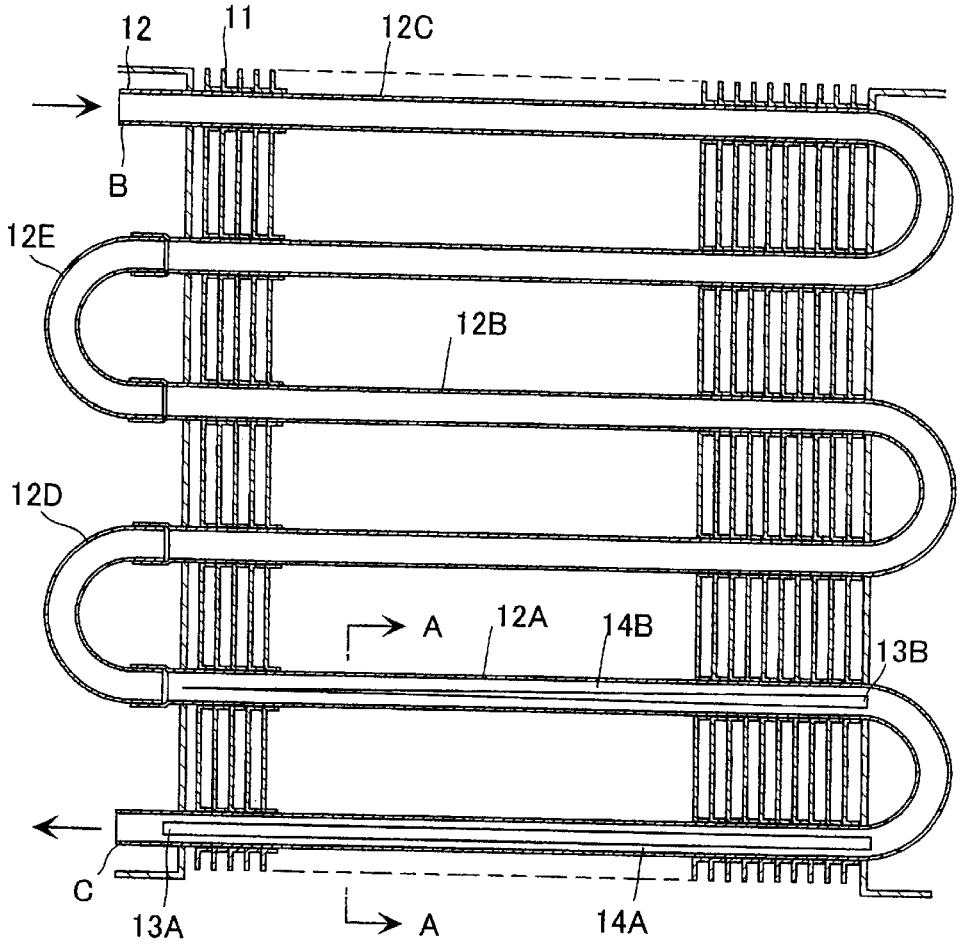
FIG. 1*a* is a sectional view of a heat exchanger having fins according to an embodiment of the present invention taken along the center line of a heat exchanger tube.
FIG. 1*b* is a sectional view taken along the line A—A in FIG. 1*a;*
Figure 1:
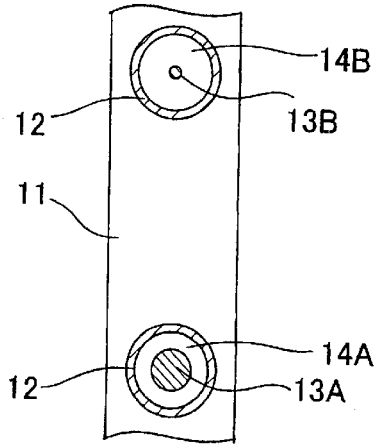
Figure 14:
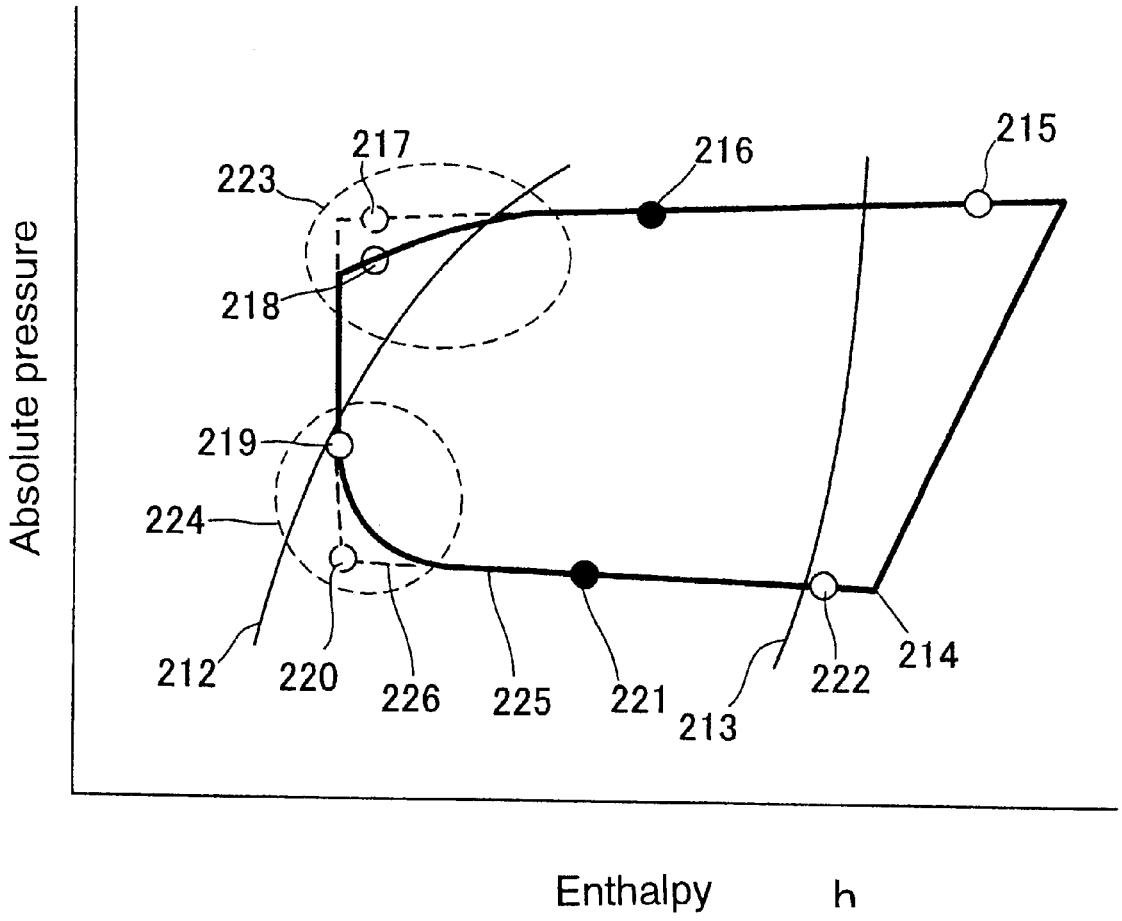
FIG. 14 is an image view in which operation points of refrigerating cycle are added to Mollier chart.

FIG. 1*a* is a sectional view of a heat exchanger having fins taken along the center line of a heat exchanger tube and FIG. 1*b* is a sectional view taken along the line A—A in FIG. 1*a*. FIG. 14 is an image view in which operation points of refrigerating cycle are added to Mollier chart.

In FIGS. 1*a* and 1*b,* the reference number 11 represents fins, 12 represents a heat exchanger tube, 13A represents an insertion member having constant cross-sectional area, and 13B represents an insertion member having cross-sectional area which is changed continuously depending on position of a flow passage. The heat exchanger tube 12 comprises three tubes 12A, 12B and 12C formed into U-shape, a U-bent tube 12D connecting one end of the tube 12A and the tube 12B, and a U-bent tube 12E connecting the other end of the tube 12B and one end of the tube 12C. Although the heat exchanger tube 12 comprises three tubes 12A, 12B and 12C in this embodiment, the number of tubes maybe changed in accordance with ability of the heat exchanger. An insertion member 13A is provided in a flow passage 14A at the side of a heat exchanger tube end C of the tube 12A, and an insertion member 13B is provided in a flow passage 14B at the side of the U-bent tube 12D. The insertion member 13B is disposed such that its end having small cross-sectional area is located at the opening side of the tube 12A.

When this heat exchanger having fins is used as a condenser, a heat exchanger end B is an inlet of fluid flowing in the flow passage, and a heat exchanger tube end C is an outlet of fluid flowing in the flow passage. When the heat exchanger having fins is used as the condenser, gaseous fluid flows in from the heat exchanger tube end B, and liquid fluid flows out from the heat exchanger tube end C. Therefore, as the fluid flows from the heat exchanger tube end B to the heat exchanger tube end C, the mass flow rate quality of the fluid becomes smaller. The arrow indicates the direction of fluid flowing in the flow passage.

In FIG. 14, a line 212 indicates a saturated liquid line, a line 213 indicates a saturated gas line, a solid line 225 indicates an operation line when the insertion member is inserted, a broken line 226 indicates an operation line at the time of normal time when the member is not inserted, a point 214 indicates a suction point of a compressor, a point 215 indicates an inlet point of a condenser, a point 217 indicates an outlet point of the condenser at the time of normal time when the member is not inserted, a point 219 indicates an inlet point of an evaporator when the member is inserted, a point 220 indicates an inlet point of the evaporator at the time of normal time when the member is not inserted, a point 222 indicates an outlet point of the evaporator, a point 216 indicates an average condensation temperature, a point 221 indicates an average evaporation temperature, an area 223 indicates an area in the vicinity of the condenser outlet, and an area 224 indicates an area in the vicinity of the evaporator inlet.

When the heat exchanger is used as a condenser, in FIG. 1*a,* fluid flowing in the heat exchanger tube flows in from the side of the heat exchanger end B and flows out toward the heat exchanger end C. During that time, the heat exchange is carried out between the fluid and air current flowing in the gap between the fins provided around the outer periphery of the heat exchanger tube 12. The flow passage 14B is gradually narrowed by the insertion member 13B, and the flow passage 14A is narrowed by the insertion member 13A. Therefore, the speed the fluid flowing in the tube 12A gradually becomes faster in the flow passage 14B and the fluid flows in the flow passage 14A at the highest speed and thus, the heat transfer coefficient in the tube is enhanced.

In the present embodiment, since the insertion members 13A and 13B are inserted in the vicinity 223 of the condenser outlet, the pressure loss is increased only in the vicinity of the condenser outlet 223 as shown in FIG. 14, and the average condensation temperature 216 is restrained from being lowered. In a gas-liquid two-phase region, since the condensed liquid is also adhered to the outer peripheral surfaces of the insertion members 13A and 13B, the thickness of the condensed liquid film of the inner peripheral surface of the tube 12A can be reduced, and the heat transfer coefficient in the tube can be enhanced. Further, by providing the insertion members 13A and 13B, the volume in the tube 12A can be reduced, and the amount of refrigerant to be charged can be reduced.

When the heat exchanger is used as the evaporator, in FIG. 1*a,* the fluid flowing in the heat exchanger tube flows in the opposite direction from that when the heat exchanger is used as the condenser, the fluid flowing in the heat exchanger tube flows in from the side of the heat exchanger end C and flows out toward the heat exchanger end B. During that time, the heat exchange is carried out between the fluid and air current flowing in the gap between the fins provided around the outer periphery of the heat exchanger tube 12. The flow passage 14A is gradually narrowed by the insertion member 13A, and the flow passage 14B is gradually narrowed by the insertion member 13B. Therefore, the speed the fluid flowing in the tube 12A becomes faster and thus, the heat transfer coefficient in the tube is enhanced.

In the present embodiment, since the insertion members 13A and 13B are. inserted in the vicinity 224 of the evaporator, as shown with the solid line 225 in FIG. 14, the pressure loss is increased in the vicinity 224 of the evaporator inlet, and as the mass flow rate quality is increased, the cross-sectional area of the flow passage is increased and thus, the pressure loss is reduced. Therefore, even if the pressure loss is increased, the pressure loss is increased only in the vicinity 224 of the evaporator, the heat transfer coefficient is enhanced due to the increase in flowing speed of the fluid, and the evaporation ability can be enhanced. Therefore, it is possible to restrain at least the evaporation ability from being lowered.

It is preferable that the shape of the cross section of each of the insertion members 13A and 13B is polygonal shape or starlike shape, in addition to substantially circular shape. Each of the insertion members 13A and 13B comprises a solid bar-member or a hollow bar-like member whose opposite ends are closed. The material of the each of the insertion members 13A and 13B is metal such as iron or aluminum or resin having corrosion resistance with respect to the refrigerant.

(Second Embodiment)

Figure 2:
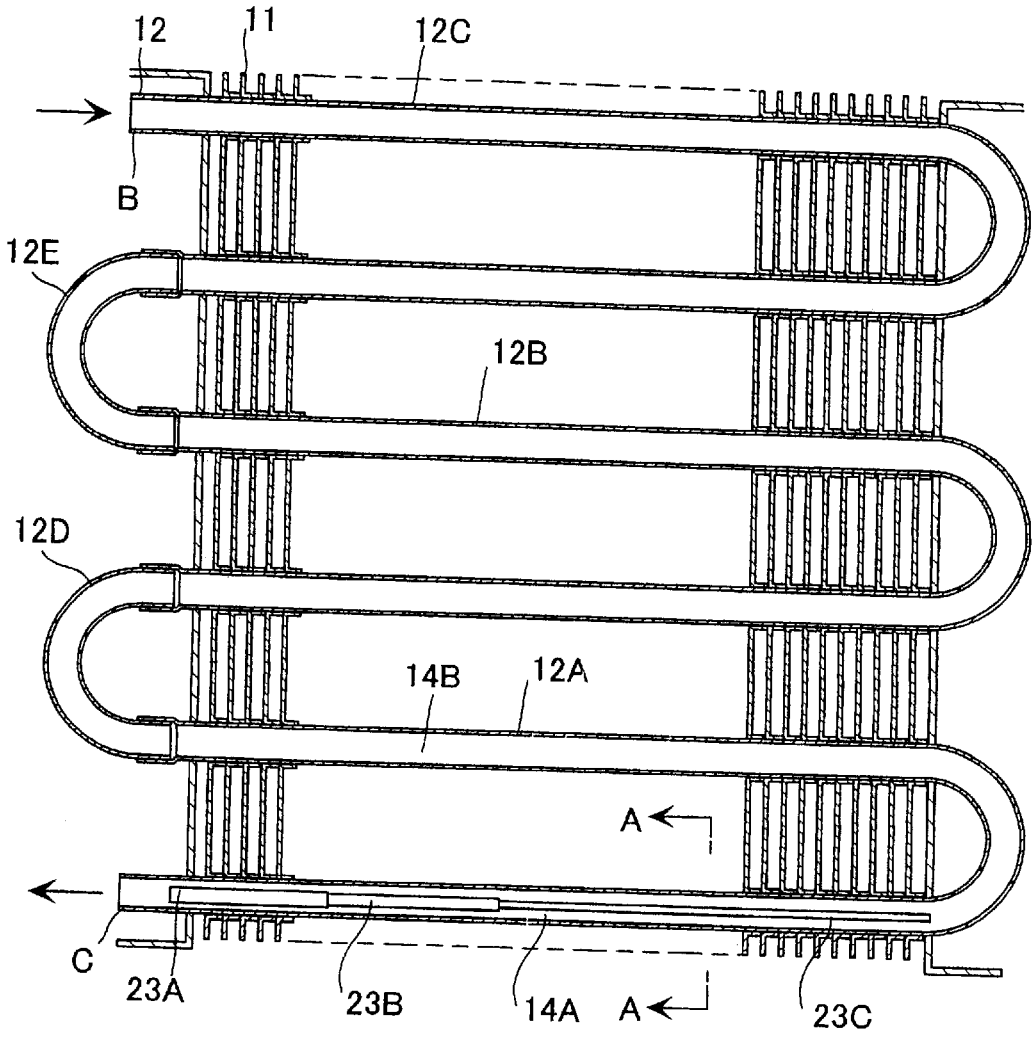
FIG. 2*a* is a sectional view of a heat exchanger having fins according to another embodiment of the invention taken along the center line of a heat exchanger tube.
FIG. 2*b* is a sectional view taken along the line A—A in FIG. 2*a;*
Figure 2:
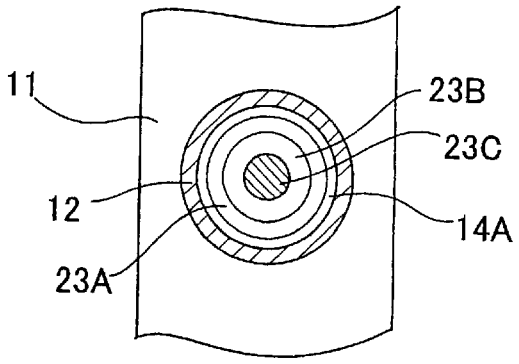

FIG. 2*a* is a sectional view of a heat exchanger having fins according to another embodiment of the invention taken along the center line of a heat exchanger tube, and FIG. 2*b* is a sectional view taken along the line A—A in FIG. 2*a*. The same members as those in the above embodiment are designated with the same reference numbers, and detailed explanation thereof will be omitted.

In the second embodiment, as shown in FIGS. 2*a* and 2*b,* insertion members 23A, 23B and 23C are provided in the flow passage 14A of the tube 12A. Here, the cross-sectional area of each of the insertion members 23A, 23B and 23C is constant, the cross-sectional area of the insertion member 23A is greater than that of the insertion member 23B, and the cross-sectional area of the insertion member 23B is greater than that of the insertion member 23C. The insertion members 23A, 23B and 23C are connected in this order. The insertion member 23A having the greatest cross-sectional area is disposed at the side of the heat exchanger tube end C.

Since the insertion members comprise the insertion members 23A, 23B and 23C, and the insertion member 23A is disposed at the side of the heat exchanger tube end C in this manner, the flow passage 14 in which the fluid can flow is gradually narrowed as the mass flow rate quality becomes smaller, the current speed of the fluid flowing in the flow passage 14 is enhanced, and the heat transfer coefficient in the tube is enhanced.

When the heat exchanger is used as the condenser, in the present embodiment also, since the insertion members 23A, 23B and 23C are inserted in the vicinity 223 of the condenser outlet, the pressure loss is increased only in the vicinity of the condenser outlet 223, and the average condensation temperature 216 is restrained from being lowered. In a gas-liquid two-phase region, since the condensed liquid is also adhered to the outer peripheral surfaces of the insertion members 23A, 23B and 23C, the thickness of the condensed liquid film of the inner peripheral surface of the tube 12A can be reduced, and the heat transfer coefficient in the tube can be enhanced. Further, by providing the insertion members 23A, 23B and 23C, the volume in the tube 12A can be reduced, and the amount of refrigerant to be charged can be reduced.

When the heat exchanger is used as the evaporator, in the present embodiment also, since the insertion members 23A, 23B and 23C are inserted in the vicinity 224 of the evaporator, as shown with the solid line 225 in FIG. 14, the pressure loss is increased in the vicinity 224 of the evaporator inlet, and as the mass flow rate quality is increased, the cross-sectional area of the flow passage is increased and thus, the pressure loss is reduced. Therefore, even if the pressureloss is increased, the pressure loss is increased only in the vicinity 224 of the evaporator, the heat transfer coefficient is enhanced due to the increase in flowing speed of the fluid, and the evaporation ability can be enhanced. Therefore, it is possible to restrain at least the evaporation ability from being lowered.

Further, as in the present embodiment, it is possible to easily vary the cross-sectional area of the flow passage by combining insertion members having different diameters.

Although the description has been made in the present embodiment while taking, as an example, the case in which only the flow passage 14A is provided with the insertion members, the flow passage 14B may be provided with the insertion member 24B, and the tube 12B may be provided at its lower flow passage with the insertion member 24C, and insertion members having different cross-sectional areas may be provided in steps (in front and behind the bent portion of the heat exchanger tubes) of the tubes.

(Third Embodiment)

Figure 3:
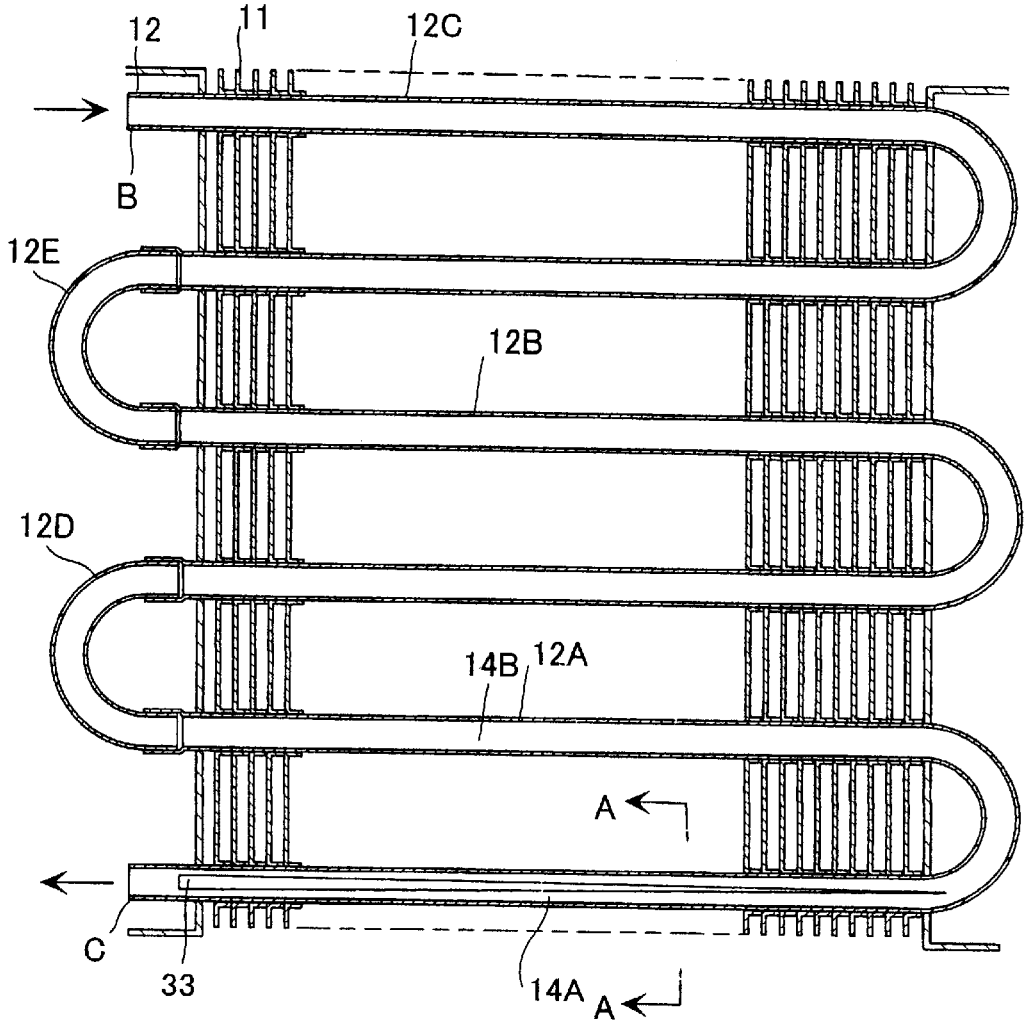
FIG. 3*a* is a sectional view of a heat exchanger having fins according to another embodiment of the invention taken along the center line of a heat exchanger tube.
FIG. 3*b* is a sectional view taken along the line A—A in FIG. 3*a;*
Figure 3:
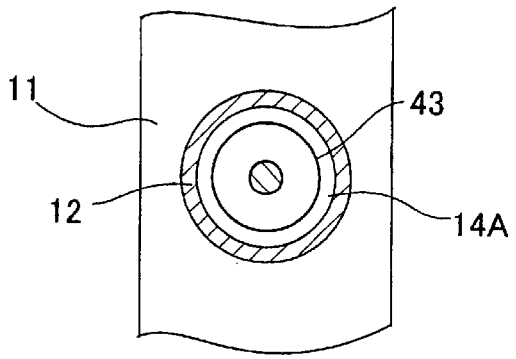

FIG. 3*a* is a sectional view of a heat exchanger having fins according to another embodiment of the invention taken along the center line of a heat exchanger tube, and FIG. 3*b* is a sectional view taken along the line A—A in FIG. 3*a*. The same members as those in the above embodiment are designated with the same reference numbers, and detailed explanation thereof will be omitted.

In the third embodiment, as shown in FIGS. 3*a* and 3*b*, an insertion member 33 whose cross-sectional area is continuously varied is provided in the flow passage 14A of the tube 12A. The insertion member 33 is disposed such that its end having greater cross-sectional area is located at the side of the heat exchanger tube end C.

Since the insertion member comprises the insertion member 33 whose cross-sectional area is continuously varied, and the insertion member 33 is disposed such that its end having greater cross-sectional area is located at the side of the heat exchanger tube end C in this manner, the flow passage 14 in which the fluid can flow is gradually narrowed as the mass flow rate quality becomes smaller, the current speed of the fluid flowing in the flow passage 14 is enhanced, and the heat transfer coefficient in the tube is enhanced.

When the heat exchanger is used as the condenser, in the present embodiment also, since the insertion member 33 is inserted in the vicinity 223 of the condenser outlet, the pressure loss is increased only in the vicinity of the condenser outlet 223, and the average condensation temperature 216 is restrained from being lowered. In a gas-liquid two-phase region, since the condensed liquid is also adhered to the outer peripheral surface of the insertion member 33, the thickness of the condensed liquid film of the inner peripheral surface of the tube 12A can be reduced, and the heat transfer coefficient in the tube can be enhanced. Further, by providing the insertion member 33, the volume in the tube 12A can be reduced, and the amount of refrigerant to be charged can be reduced.

Further, it is possible to optimally reduce the pressure loss and to exploit the full heat exchanging performance by continuously changing the cross -sectional area of the insertion member.

When the heat exchanger is used as the evaporator, in the present embodiment also, since the insertion member 33 is inserted in the vicinity 224 of the evaporator, as shown with the solid line 225 in FIG. 14, the pressure loss is increased in the vicinity 224 of the evaporator inlet, and as the mass flow rate quality is increased, the cross-sectional area of the flow passage is increased and thus, the pressure loss is reduced. Therefore, even if the pressure loss is increased, the pressure loss is increased only in the vicinity 224 of the evaporator, the heat transfer coefficient is enhanced due to the increase in flowing speed of the fluid, and the evaporation ability can be enhanced. Therefore, it is possible to restrain at least the evaporation ability from being lowered.

Although the description has been made in the present embodiment while taking, as an example, the case in which only the flow passage 14A is provided with the insertion member, the flow passage 14B may also be provided with an insertion member, and the tube 12B may also be provided at its lower flow passage with an insertion member. When the insertion members are provided in a plurality of tubes, it is preferable that the cross-sectional area of each of the insertion members is continuously varied.

(Fourth Embodiment)

Figure 4:
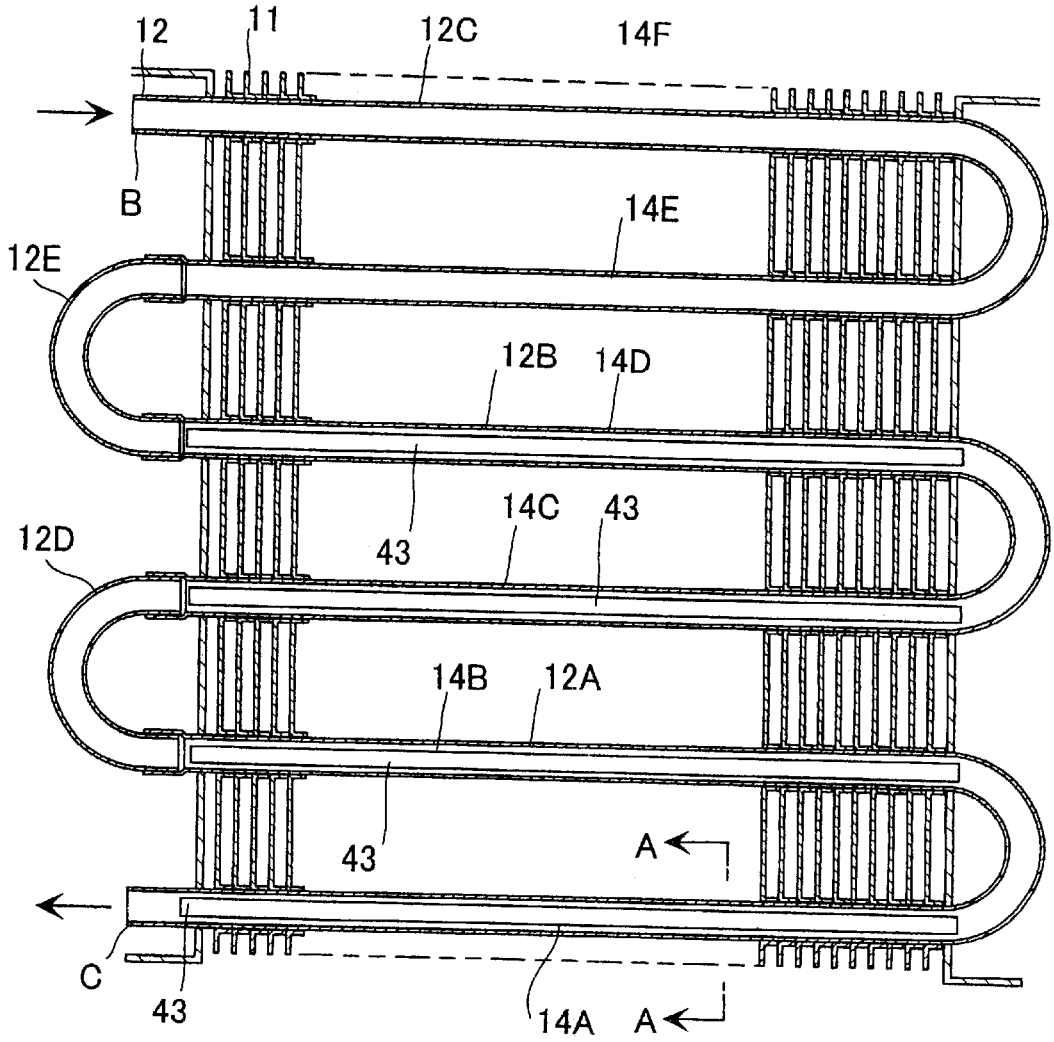
FIG. 4*a* is a sectional view of a heat exchanger having fins according to another embodiment of the invention taken along the center line of a heat exchanger tube.
FIG. 4*b* is a sectional view taken along the line A—A in FIG. 4*a;*
Figure 4:
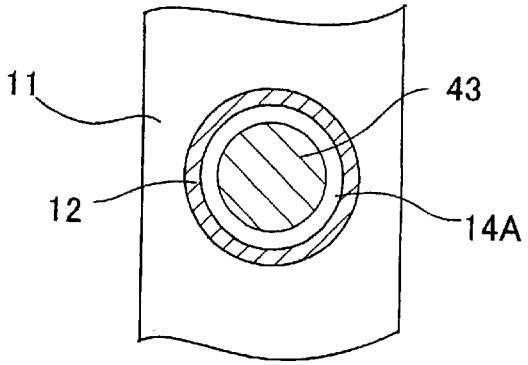

FIG. 4*a* is a sectional view of a heat exchanger having fins according to another embodiment of the invention taken along the center line of a heat exchanger tube, and FIG. 4*b* is a sectional view taken along the line A—A in FIG. 4*a*. The same members as those in the above embodiment are designated with the same reference numbers, and detailed explanation thereof will be omitted.

As shown in FIGS. 4*a* and 4*b*, insertion members 43 each having a constant cross-sectional area are provided in flow passages 14A and 14B of the tube 12A as well as in flow passages 14C and 14D of the tube 12B. No insertion members is provided in each of the flow passages 14E and 14F of the tube 12C.

Since the flow passages 14A, 14B, 14C and 14D having small mass flow rate qualities are narrower than the flow passages 14E and 14F having great mass flow rate qualities, the current speed of the fluid flowing in the flow passages 14A, 14B, 14C and 14D is enhanced, and the heat transfer coefficient in the tube is enhanced.

When the heat exchanger is used as the condenser, in the present embodiment also, since the insertion member 43 is inserted at the side of the condenser outlet, the average condensation temperature 216 is restrained from being lowered. In a gas-liquid two-phase region, since the condensed liquid is also adhered to the outer peripheral surface of the insertion member 43, the thickness of the condensed liquid film of the inner peripheral surfaces of the tubes 12A and 12B can be reduced, and the heat transfer coefficient in the tube can be enhanced. Further, by providing the insertion member 43, the volume in each of the tubes 12A and 12B can be reduced, and the amount of refrigerant to be charged can be reduced.

When the heat exchanger is used as the evaporator, in the present embodiment also, since the insertion member 43 is inserted at the side of the evaporator inlet, the pressure loss is great at the side of the evaporator inlet, and in a place where the mass flow rate quality is great, the cross-sectional area of the flow passage is great and thus, the pressure loss is reduced. Therefore, even if the pressure loss is increased, the pressure loss is increased only at the side of the evaporator inlet, the heat transfer coefficient is enhanced due to the increase in flowing speed of the fluid, and the evaporation ability can be enhanced. Therefore, it is possible to restrain at least the evaporation ability from being lowered.

Further, by using the insertion members 43 each having the constant cross-sectional area, since a large number of the same members, it is possible to reduce the costs of the insertion members to the minimum.

(Fifth Embodiment)

Figure 5:
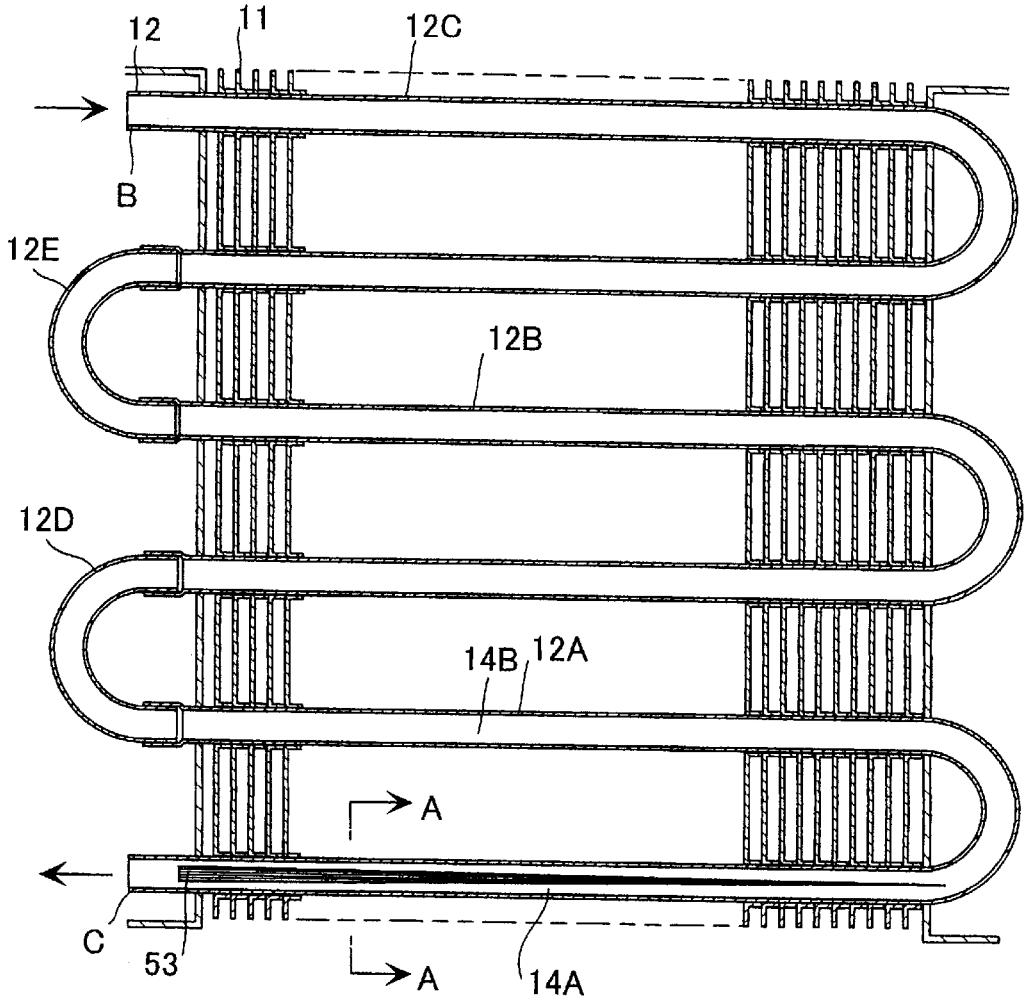
FIG. 5*a* is a sectional view of a heat exchanger having fins according to another embodiment of the invention taken along the center line of a heat exchanger tube.
FIG. 5*b* is a sectional view taken along the line A—A in FIG. 5*a;*
Figure 5:
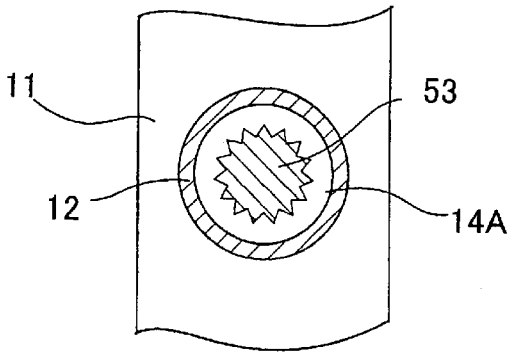

FIG. 5*a* is a sectional view of a heat exchanger having fins according to another embodiment of the invention taken along the center line of a heat exchanger tube, and FIG. 5*b* is a sectional view taken along the line A—A in FIG. 5*a*. The same members as those in the above embodiment are designated with the same reference numbers, and detailed explanation thereof will be omitted.

As shown in FIGS. 5*a* and 5*b,* in a flow passage 14A of the tube 12A, an insertion member 53 whose cross-sectional area is continuously varied and formed with a plurality of grooves 53A in a longitudinal direction of an outer surface thereof is provided. The insertion member 53 is disposed such that its one end having greater cross-sectional area is located at the side of the heat exchanger tube end C.

Since the insertion member comprises the insertion member 53 whose cross-sectional area is continuously varied, and the insertion member 33 is disposed such that its end having greater cross-sectional area is located at the side of the heat exchanger tube end C in this manner, the flow passage 14 in which the fluid can flow is gradually narrowed as the mass flow rate quality becomes smaller, the current speed of the fluid flowing in the flow passage 14 is enhanced, and the heat transfer coefficient in the tube is enhanced.

When the heat exchanger is used as the condenser, in the present embodiment also, since the insertion member 53 is inserted in the vicinity 223 of the condenser outlet, the pressure loss is increased only in the vicinity of the condenser outlet 223, and the average condensation temperature 216 is restrained from being lowered. The condensed liquid is adhered to the outer peripheral surface of the insertion member 53, but since the amount of the condensed liquid adhered to the insertion member 53 is increased because the outer area of the insertion member 53 is increased due to the grooves 53A, the thickness of the condensed liquid film of the inner peripheral surface of the tube 12A can further be reduced, and the heat transfer coefficient in the tube is enhanced. Further, the volume in the heat exchanger tube can be reduced by the insertion member, and the amount of refrigerant to be charged can be reduced.

Further, since the diameter of the insertion member is continuously varied, it is possible to optimally reduce the pressure and to exploit the full ability.

When the heat exchanger is used as the evaporator, in the present embodiment also, since the insertion member 53 is inserted in the vicinity 224 of the evaporator, as shown with the solid line 225 in FIG. 14, the pressure loss is increased in the vicinity 224 of the evaporator inlet, and as the mass flow rate quality is increased, the cross-sectional area of the flow passage is increased and thus, the pressure loss is reduced. Therefore, even if the pressure loss is increased, the pressure loss is increased only in the vicinity 224 of the evaporator, the heat transfer coefficient is enhanced due to the increase in flowing speed of the fluid, and the evaporation ability can be enhanced. Therefore, it is possible to restrain at least the evaporation ability from being lowered.

Although FIG. 5*a* shows straight grooves, if helical grooves are provided, turbulent flow is promoted, which enhances the heat transfer coefficient and thus, the ability is enhanced.

Further, the cross-sectional area of the insertion member 53 may be varied in front and behind the bent portion of the heat exchanger tube. The same effect can be obtained even if the groove is formed with bumps and dips by dimple processing.

(Sixth Embodiment)

Figure 6:
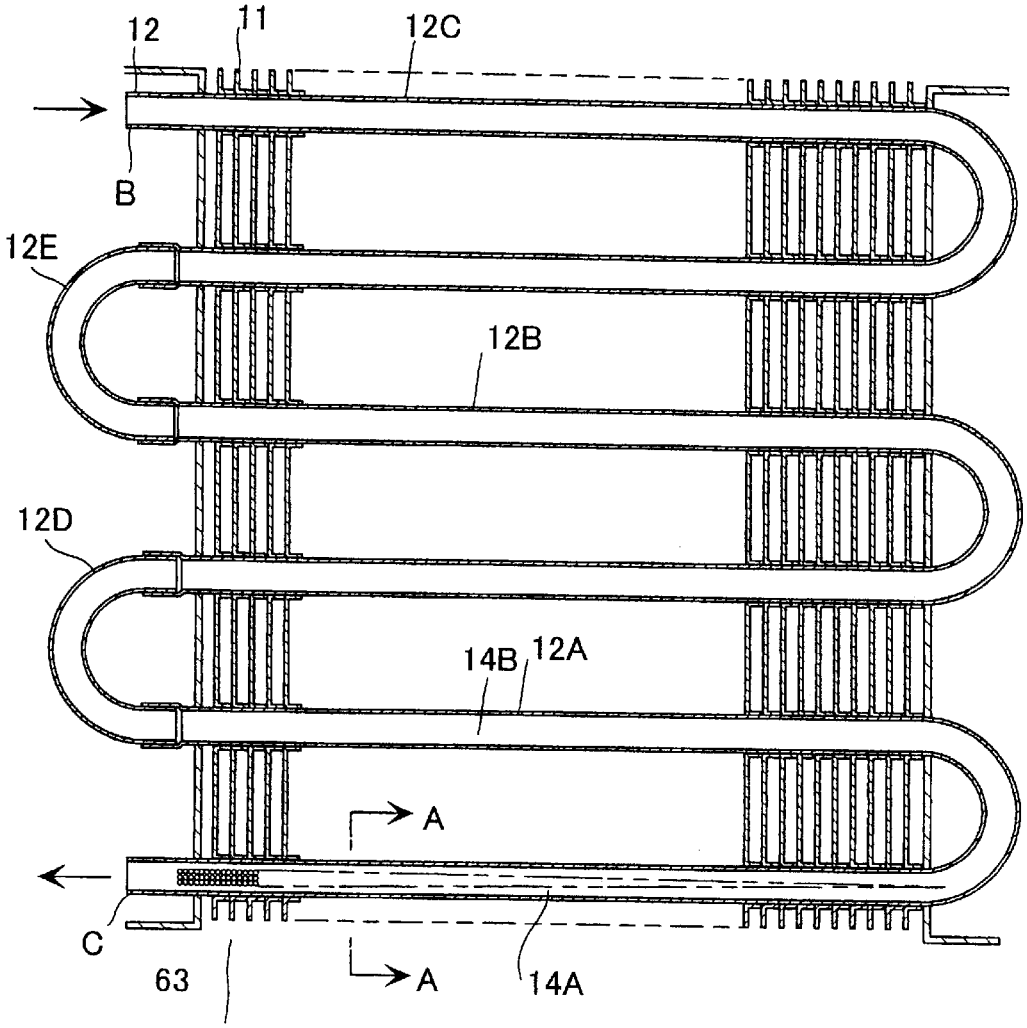
FIG. 6*a* is a sectional view of a heat exchanger having fins according to another embodiment of the invention taken along the center line of a heat exchanger tube.
FIG. 6*b* is a sectional view taken along the line A—A in FIG. 6*a;*
Figure 6:
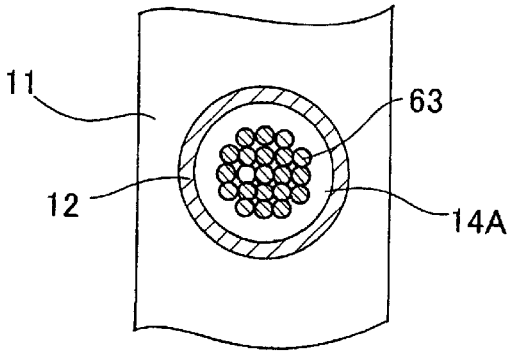

FIG. 6*a* is a sectional view of a heat exchanger having fins according to another embodiment of the invention taken along the center line of a heat exchanger tube, and FIG. 6*b* is a sectional view taken along the line A—A in FIG. 6*a*. The same members as those in the above embodiment are designated with the same reference numbers, and detailed explanation thereof will be omitted.

In the sixth embodiment, as shown in FIGS. 6*a* and 6*b,* an insertion member 63 made of porous material and whose cross-sectional area is continuously varied is provided in the flow passage 14A of the tube 12A. The insertion member 63 is disposed such that its one end having greater cross-sectional area is located at the side of the heat exchanger tube end C.

Since the insertion member comprises the insertion member 63 whose cross-sectional area is continuously varied, and the insertion member 63 is disposed such that its end having greater cross-sectional area is located at the side of the heat exchanger tube end C in this manner, the flow passage 14A in which the fluid can flow is gradually narrowed as the mass flow rate quality becomes smaller, the current speed of the fluid flowing in the flow passage 14A is enhanced, and the heat transfer coefficient in the tube is enhanced.

When the heat exchanger is used as the condenser, in the present embodiment also, since the insertion member 63 is inserted in the vicinity 223 of the condenser outlet, the pressure loss is increased only in the vicinity of the condenser outlet 223, and the average condensation temperature 216 is restrained from being lowered. The condensed liquid is adhered to the outer peripheral surface of the insertion member 63, but since the insertion member 63 is formed into porous shape, the outer area of the insertion member 63 can be increased, the thickness of the condensed liquid film of the inner peripheral surface of the tube 12A can further be reduced, and the heat transfer coefficient in the tube is enhanced. Further, the volume in the heat exchanger tube can be reduced by the insertion member, and the amount of refrigerant to be charged can be reduced.

Further, since the diameter of the insertion member 63 is continuously varied, it is possible to optimally reduce the pressure and to exploit the full ability.

When the heat exchanger is used as the evaporator, in the present embodiment also, since the insertion member 63 is inserted in the vicinity 224 of the evaporator, as shown with the solid line 225 in FIG. 14, the pressure loss is increased in the vicinity 224 of the evaporator inlet, and as the mass flow rate quality is increased, the cross-sectional area of the flow passage is increased and thus, the pressure loss is reduced. Therefore, even if the pressure loss is increased, the pressure loss is increased only in the vicinity 224 of the evaporator, the heat transfer coefficient is enhanced due to the increase in flowing speed of the fluid, and the evaporation ability can be enhanced. Therefore, it is possible to restrain at least the evaporation ability from being lowered.

Although FIG. 6*a* shows the member formed by hardening fine particles, the same effect can be obtained even if the porous member is formed by adhering the particles onto a smooth outer surface in view of strength. Further, even if particles having different particle diameter are mixed, the same effect can be obtained. The cross-sectional area of the insertion member 63 may be varied in front of and behind the bent portion of the heat exchanger tube.

(Seventh Embodiment)

Figure 7:
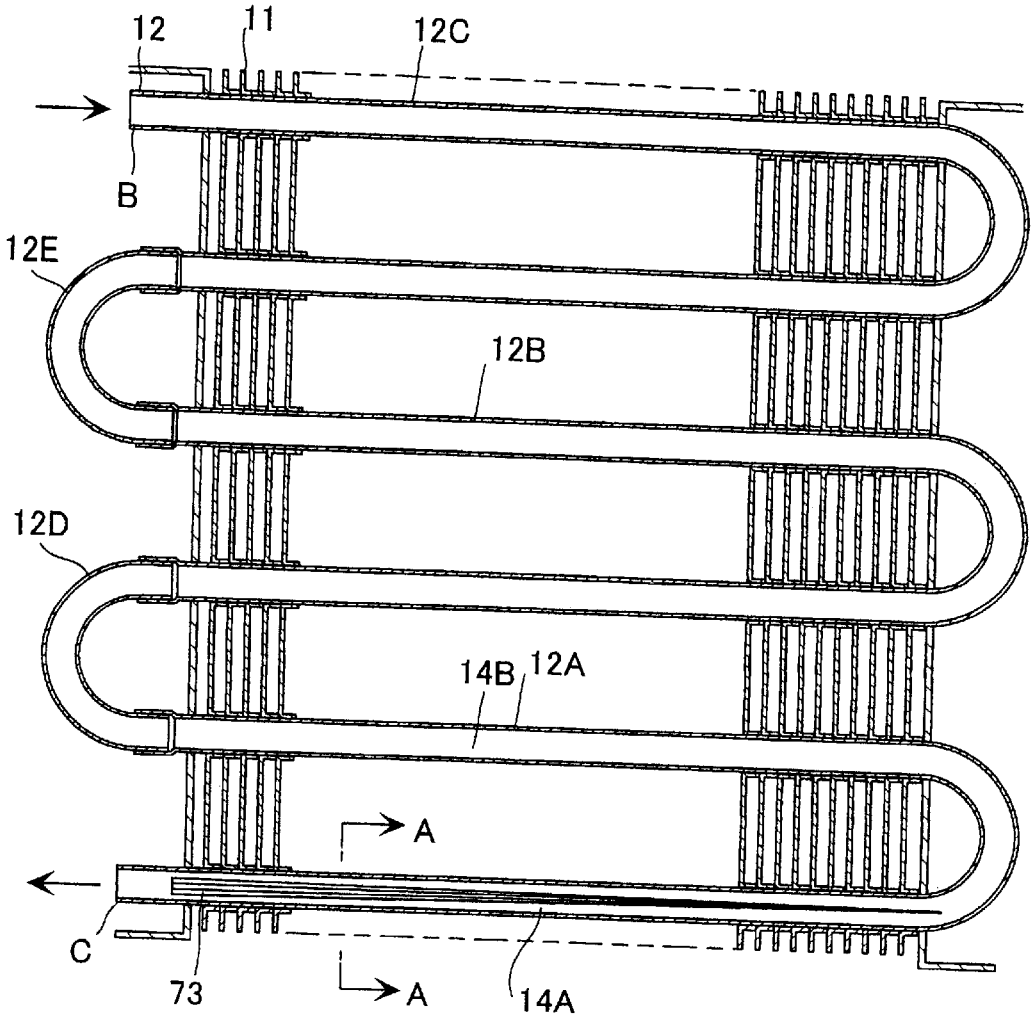
FIG. 7*a* is a sectional view of a heat exchanger having fins according to another embodiment of the invention taken along the center line of a heat exchanger tube.
FIG. 7*b* is a sectional view taken along the line A—A in FIG. 7*a;*
Figure 7:
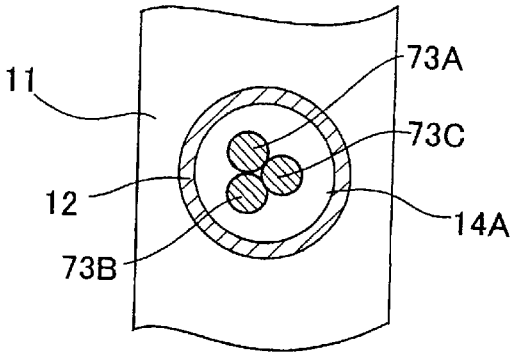

FIG. 7*a* is a sectional view of a heat exchanger having fins according to another embodiment of the invention taken along the center line of a heat exchanger tube, and FIG. 7*b* is a sectional view taken along the line A—A in FIG. 7*a*. The same members as those in the above embodiment are designated with the same reference numbers, and detailed explanation thereof will be omitted.

According to the present embodiment, as shown in FIGS. 7*a* and 7*b*, a plurality of insertion members 73A, 73B and 73C are tied in a bundle and provided in the flow passage 14A of the tube 12A. The cross-sectional area of each of the insertion members 73 is continuously varied. The insertion member 73 is disposed such that its one end having greater cross-sectional area is located at the side of the heat exchanger tube end C.

Since the insertion member comprises the insertion member 73 whose cross-sectional area is continuously varied, and the insertion member 73 is disposed such that its end having greater cross-sectional area is located at the side of the heat exchanger tube end C in this manner, the flow passage 14A in which the fluid can flow is gradually narrowed as the mass flow rate quality becomes smaller, the current speed of the fluid flowing in the flow passage 14A is enhanced, and the heat transfer coefficient in the tube is enhanced.

When the heat exchanger is used as the condenser, in the present embodiment also, since the insertion member 73 is inserted in the vicinity 223 of the condenser outlet, the pressure loss is increased only in the vicinity of the condenser outlet 223, and the average condensation temperature 216 is restrained from being lowered. The condensed liquid is adhered to the outer peripheral surface of the insertion member 73, but since the plurality of insertion members 73A, 73B and 73C are tied into a bundle, the outer area of the insertion member 73 can be increased, the thickness of the condensed liquid film of the inner peripheral surface of the tube 12A can further be reduced, and the heat transfer coefficient in the tube is enhanced. Further, the volume in the heat exchanger tube can be reduced by the insertion member, and the amount of refrigerant to be charged can be reduced.

Further, since the diameter of the insertion member 73 is continuously varied, it is possible to optimally reduce the pressure and to exploit the full ability.

When the heat exchanger is used as the evaporator, in the present embodiment also, since the insertion member 73 is inserted in the vicinity 224 of the evaporator, as shown with the solid line 225 in FIG. 14, the pressure loss is increased in the vicinity 224 of the evaporator inlet, and as the mass flow rate quality is increased, the cross-sectional area of the flow passage is increased and thus, the pressure loss is reduced. Therefore, even if the pressure loss is increased, the pressure loss is increased only in the vicinity 224 of the evaporator, the heat transfer coefficient is enhanced due to the increase in flowing speed of the fluid, and the evaporation ability can be enhanced. Therefore, it is possible to restrain at least the evaporation ability from being lowered.

Figure 8:
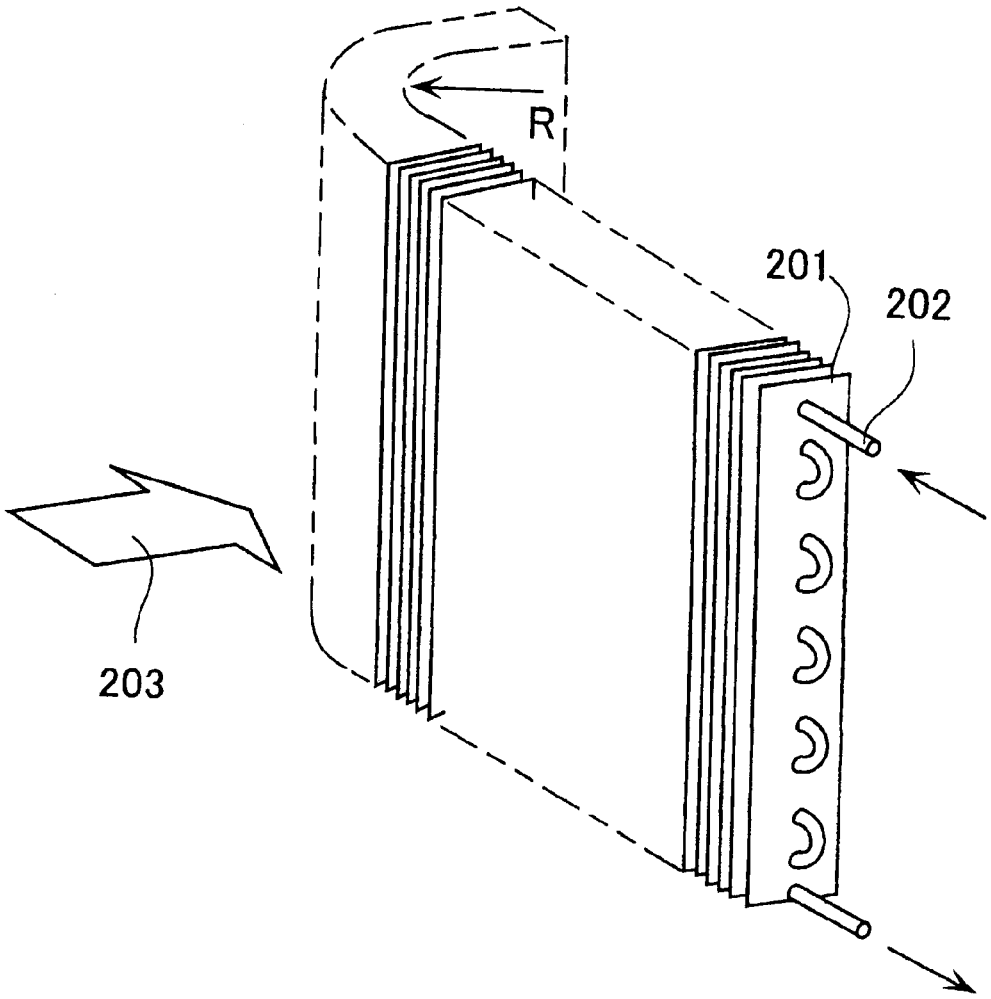
FIG. 8 is a perspective view of the heat exchanger having fins.
Figure 9:
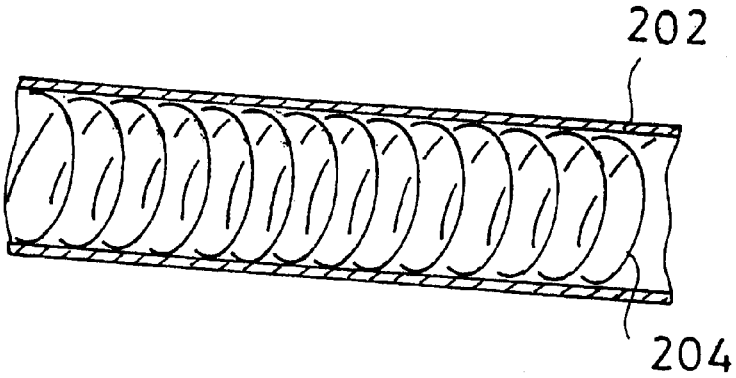
FIG. 9*a* is a vertical sectional view showing a portion of a heat exchanger tube according to a first prior art.
FIG. 9*b* is an enlarged sectional view of an essential portion showing an inner wall surface of the heat exchanger tube.
Figure 9:
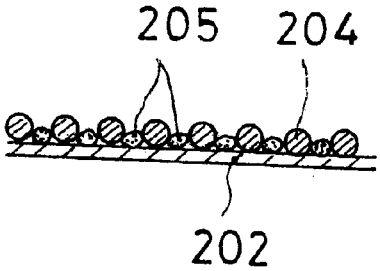
PRIOR ART FIG. 9 (b)
Figure 10:
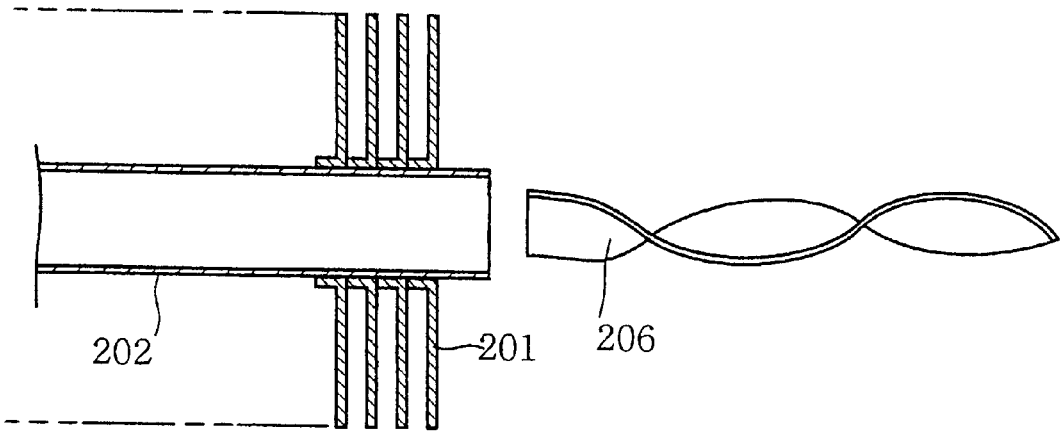
FIG. 10 is a sectional view of a heat exchanger having fins according to a second prior art taken along the surface passing through the center line of a heat exchanger tube.
Figure 11:
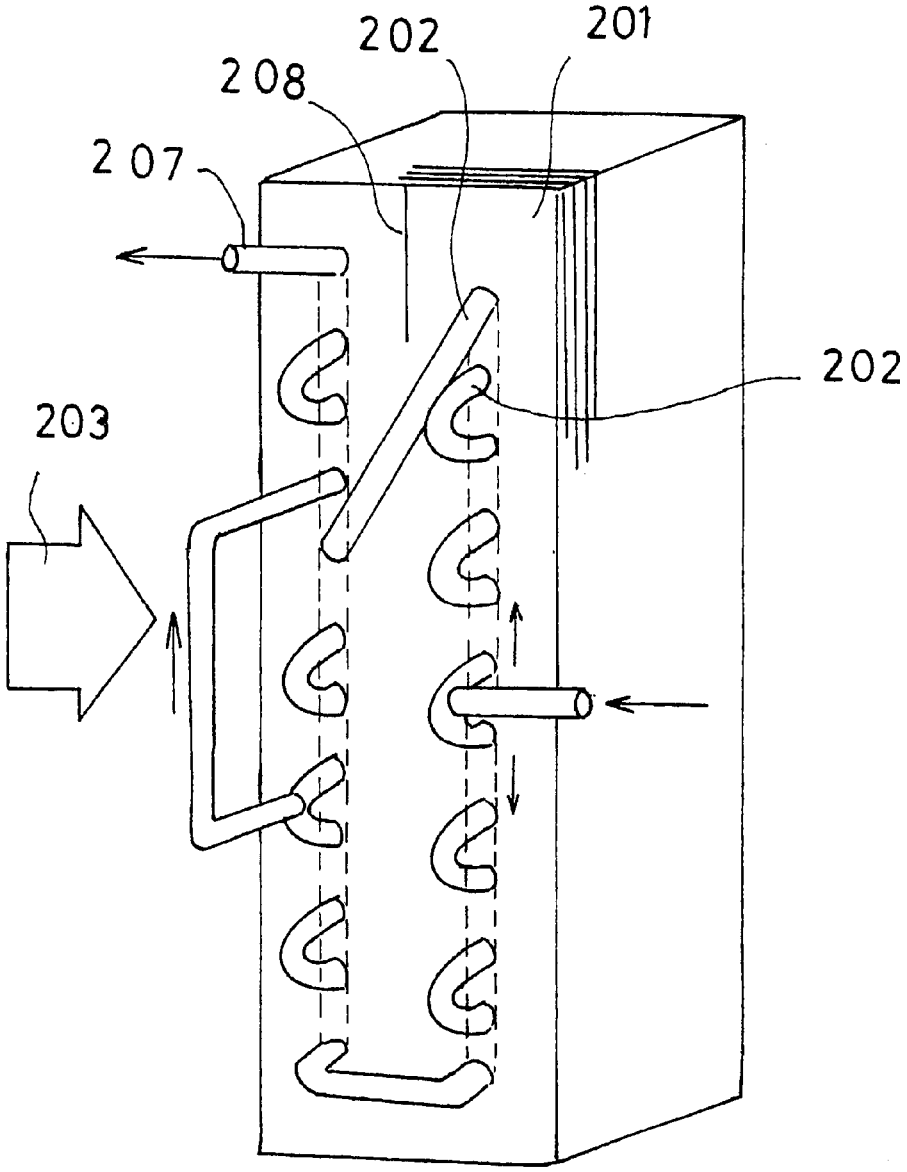
FIG. 11 is a perspective view showing a construction of a heat exchanger having fins according to a third prior art.
Figure 12:
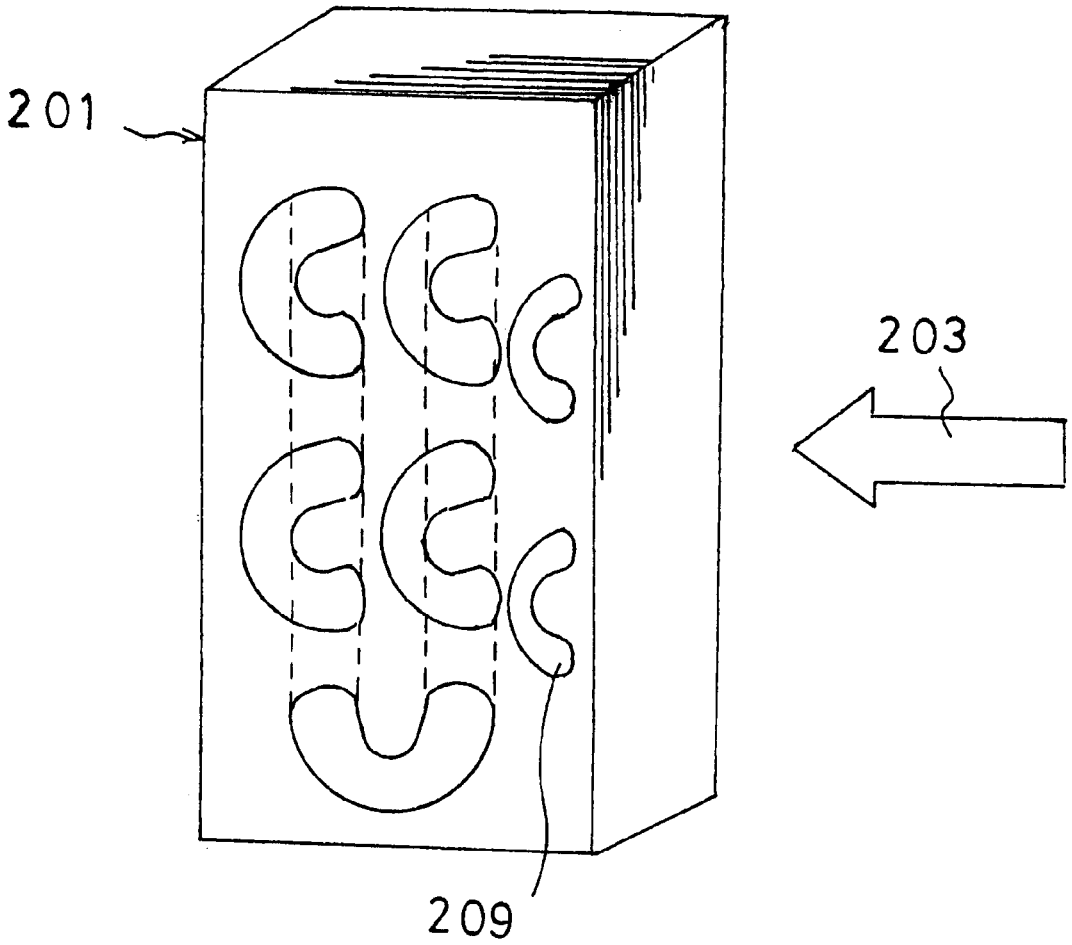
FIG. 12 is a perspective view showing a construction of a heat exchanger having fins according to a fourth prior art.
Figure 13:
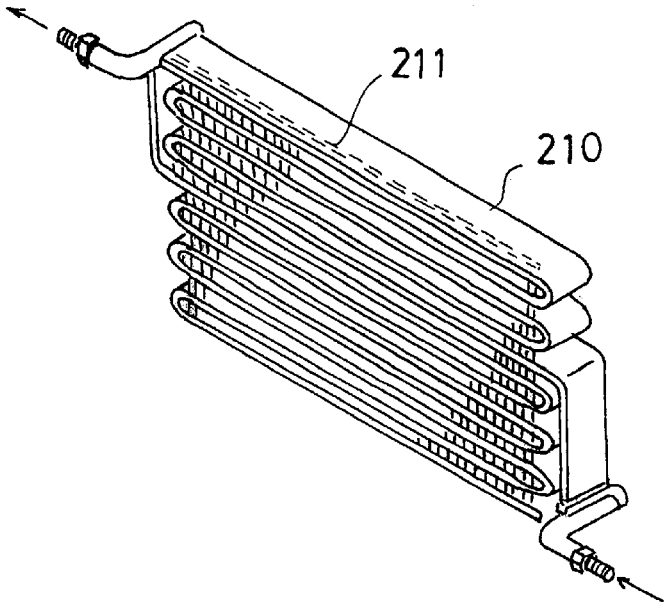
FIG. 13*a* is a perspective view showing a construction of a heat exchanger having fins according to a fifth prior art.
FIG. 13*b* is a sectional view of a heat exchanger tube constituting the heat exchanger.
Figure 13:
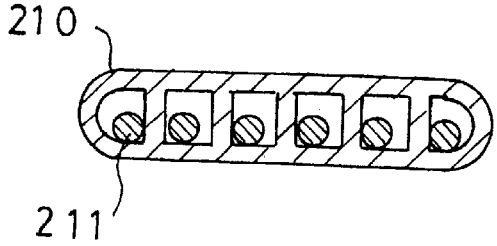
PRIOR ART FIG. 13 (b)

Further, as shown in FIG. 8, when the heat exchanger tube is bent to form a heat exchanger, it is possible to restrain the deformation of the member at the bent portion and thus, the processing is easy.

Although FIG. 7*a* shows straight bars, if helically twisted bars are combined, turbulent flow is promoted, which enhances the heat transfer coefficient and thus, the ability is enhanced.

Although the fluid is not specifically described in the above embodiments, the following refrigerant can be used.

Although a single refrigerant (R22) is conventionally used as a refrigerant used for an air conditioner, single refrigerant or azeotropic refrigerant having small temperature gradient of air temperature in a refrigeration cycle, such as R32/R125 (50/50 wt %) (which will be referred to as R410A hereinafter) in hydro fluorocarbon (HFC), or propane (R290) in hydrocarbon (HC) may be used as a substitutable refrigerant. Each of these refrigerants has greater refrigerant density at the same cycle point as compared with the conventional R22 in the refrigeration cycle and thus, has characteristic that the current speed is reduced.

That is, when the same ability is required, the pressure loss of the R410 in a heat exchanger or a tube is about 70% of that of the R22.

For this reason, if refrigerant such as R410A, propane (R290) or the like is used, the heat transfer coefficient is enhanced, and the efficient of the heat exchanger is enhanced. Further, if the hydro fluorocarbon (HFC) or hydrocarbon (HC) is used, the value of the ozone destroy potential (ODP) is 0. Although the value of the global warming potential (GWP) of the hydro fluorocarbon (HFC) is high, the global warming potential (GWP) of the hydrocarbon (HC) is extremely closer to 0. Therefore, the environmental problem can be overcome.

What is claimed is:

1. A heat exchanger for exchanging heat between fluid flowing in a flow passage in a heat exchanger tube and fluid flowing outside of said heat exchanger tube, the flow passage including a first passage where fluid flows in a gas phase state, a second passage where fluid flows in the gas-liquid two phase state or liquid phase state, and a U-shaped passage separating the first and second passages, wherein an insertion member is not provided in the first passage where fluid flows in a gas phase state, but a solid bar-like insertion member or a hollow bar-like insertion member whose opposite ends are closed is provided in the second passage in which the fluid flows in the gas-liquid two phase state or liquid phase state, a cross section of said insertion member is formed into a substantially circle shape, a polygonal shape or a starlike shape, wherein fluid does not flow in the insertion member, and a cross-sectional area of a flow passage in which said fluid flows is reduced as a mass flow rate quality of said fluid is reduced.

2. A heat exchanger for exchanging heat between fluid flowing in a flow passage in a heat exchanger tube and fluid flowing outside of said heat exchanger tube, the flow passage including a first passage where fluid flows in a gas phase state, a second passage where fluid flows in the gas-liquid two phase state or liquid phase state, and a U-shaped passage separating the first and second passages, wherein an insertion member is not provided in the first passage where the fluid flows in a gas phase state, but a bar-like insertion member is provided in the second passage in which the fluid flows in the gas-liquid two phase state or liquid phase state, wherein fluid does not flow in the insertion member, and a cross-sectional area of a flow passage in which said fluid flows is reduced as a mass flow rate quality of said fluid reduced.

3. A heat exchanger according to claim 1 or 2, wherein a cross-sectional area of said insertion member is discontinuously varied.

4. A heat exchanger according to claim 1 or 2, wherein a cross-sectional area of said insertion member is continuously varied.

5. A heat exchanger according to any one of claim 1 or 2 wherein said insertion member is provided on its outer surface with a groove, or a bump and a dip.

6. A heat exchanger according to any one of claim 1 or 2 wherein said insertion member is made of porous material.

7. A heat exchanger according to any one of claim 1 or 2 wherein said insertion member is provided in plural into bundle.

8. A heat exchanger according to claim 1 or 2, wherein a refrigerant comprising hydro fluorocarbon (HFC) or hydrocarbon (HC) as main component is used as said fluid flowing in said flow passage in said heat exchanger tube.

9. A heat exchanger according to claim 3, wherein said insertion member is provided on its outer surface with a groove, or a bump and a dip.

10. A heat exchanger according to claim 3, wherein said insertion member is made of porous material.

11. A heat exchanger according to claim 3, wherein said insertion member is provided in plural into bundle.

12. A heat exchanger according to claim 3, wherein a refrigerant comprising hydro fluorocarbon (HFC) or hydrocarbon (HC) as main component is used as said fluid flowing in said flow passage in said heat exchanger tube.

13. A heat exchanger according to claim 4, wherein said insertion member is provided on its outer surface with a groove, or a bump and a dip.

14. A heat exchanger according to claim 4, wherein said insertion member is made of porous material.

15. A heat exchanger according to claim 4, wherein said insertion member is provided in plural into bundle.

16. A heat exchanger according to claim 4, wherein a refrigerant comprising hydro fluorocarbon (HFC) or hydrocarbon (HC) as main component is used as said fluid flowing in said flow passage in said heat exchanger tube.

* * * * *